United States Patent [19]

Krauthamer

[11] Patent Number: 4,979,084

[45] Date of Patent: Dec. 18, 1990

[54] FINIAL SUPPORT FOR TABLE LAMP

[76] Inventor: Martin Krauthamer, 65 Beverly Rd., Great Neck, N.Y. 11021

[21] Appl. No.: 418,160

[22] Filed: Oct. 6, 1989

Related U.S. Application Data

[63] Continuation-in-part of Ser. No. 318,920, Mar. 3, 1989, abandoned.

[51] Int. Cl.[5] ..... F21V 17/00

[52] U.S. Cl. ..... 362/457; 362/356; 362/444

[58] Field of Search ..... 362/356, 357, 444, 445, 362/457, 458

[56] References Cited

U.S. PATENT DOCUMENTS

| | | | |
|---|---|---|---|
| 1,894,302 | 1/1933 | Burke | 362/356 |
| 2,264,255 | 11/1945 | Burke | 362/356 |
| 2,516,286 | 7/1950 | Yeidel | 362/357 |
| 2,997,576 | 8/1961 | Heitshu | 362/356 |
| 4,498,125 | 2/1985 | Schumaker | 362/216 |

*Primary Examiner*—Ira S. Lazarus

*Assistant Examiner*—Richard R. Cole

*Attorney, Agent, or Firm*—Levisohn, Lerner & Berger

[57] ABSTRACT

A device for supporting a decorative finial on a table lamp having a lampshade of the metal hoop-type. The lampshade is generally releasably secured to the lamp by a pair of opposed spring clips which slip over and grip the light bulb held in the socket of the lamp. The spring clips are connected by a pair of parallel wires to the circular hoop supporting the fabric of the lampshade. The device for the finial clips over the parallel wires of the spring clips and supports a finial on a less expensive hoop-type lampshade. This is in contrast to the more expensive harp and finial support provided on lampshades of higher quality lamps. The finial support comprises a plate member which is releasably secured to the parallel wires connecting between the spring clips and the circular top hoop of the lampshade. A pair of tabs releasably secure the device to the wire spokes of the lampshade. A hole in the center of the plate member is provided for threadably receiving a finial which, itself, is provided with screw threads. The device is preferably made from flexible, resilient material.

6 Claims, 2 Drawing Sheets

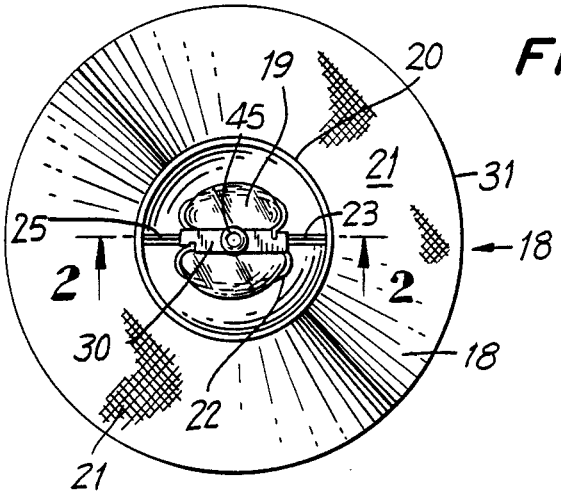
FIG. 1
FIG. 2
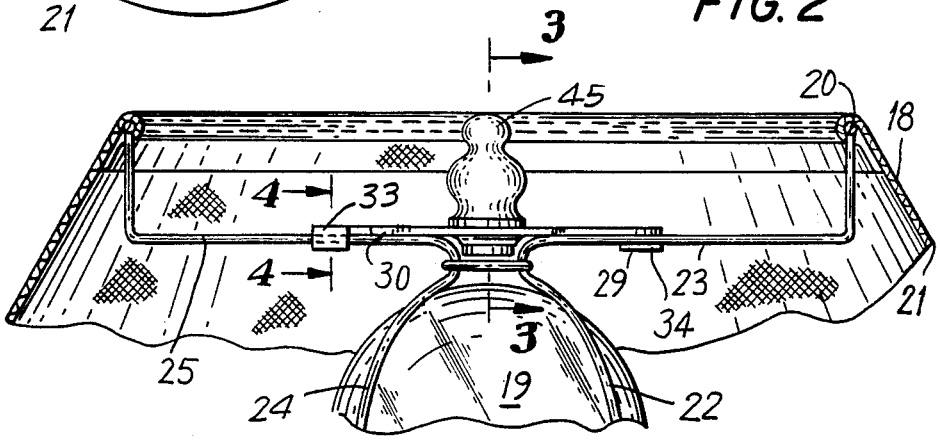
FIG. 3
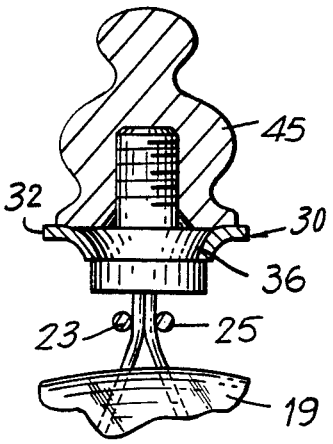
FIG. 4
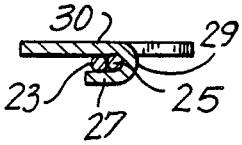
FIG. 5
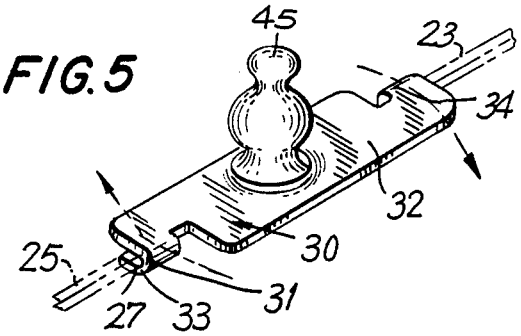

FIG. 6
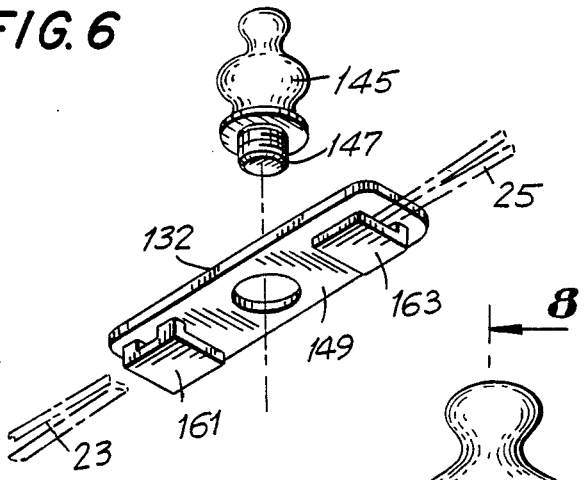
FIG. 7
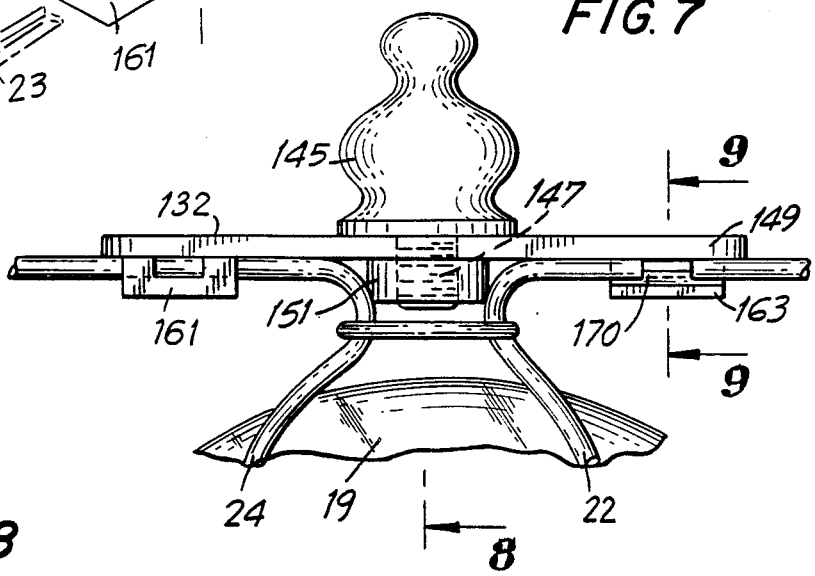
FIG. 8
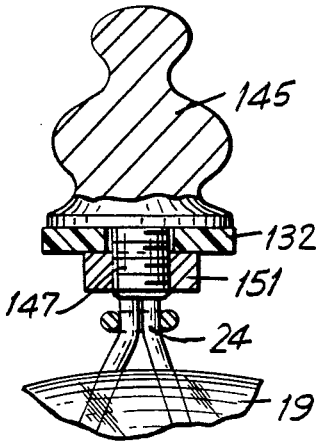
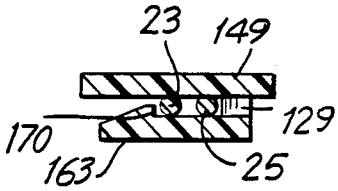
FIG. 9

FINIAL SUPPORT FOR TABLE LAMP

This application is a continuation in part of Ser. No. 07/318,920 filed March 3, 1989 now abandoned.

BACKGROUND OF THE INVENTION AND DESCRIPTION OF THE PRIOR ART

The present invention relates to table lamps and, specifically, to providing a selection of decorative finials to table lamps in a relatively inexpensive manner. Relatively expensive table lamps are provided with harps which extend upwardly around the lightbulb of the table lamp. The top of the harp has a flat surface, often a disk located above the lightbulb. This disk is provided with an upwardly extending set of screw threads. A lampshade of the circular hoop type has a plurality of inwardly directed metal spokes which meet at a central ring. The ring is placed over the disk and around the screw threads. Thus, the lampshade is suspended with the fabric of the shade held away from the lightbulb by the plurality of spoke wires extending between the outer hoop of the lampshade and the circular ring. The ring is located on top of the disk of the harp to balance and support the lampshade. After that is done, the lamp is provided with a finial which screws onto the upwardly extending set of screw threads. In this manner, these rather expensive lamps are provided with finials which provide a more visually pleasing appearance to the table lamp. In addition, the finial secures the lampshade in place.

Less expensive table lamps, however, are not provided with the upwardly extending harps, the disk, the ring of the lampshade nor screw threads for a finial but, rather, their lampshades are secured to the lamp by a pair of opposed, generally circularly-shaped spring clips which slide over and grip a lightbulb. The spring clips support and suspend the lampshade about the bulb. Generally, the spring clips, made of thin metal wire connect to the circular hoop portion of the lampshade by a pair of parallel, thin metal wires running through the center of the metal hoop of the lampshade. In this manner, the lampshade is supported and suspended about the lightbulb. This is quite conventional and well known to those of ordinary skill in the art.

It is, however, well known that these type of lampshades do not present an appearance as visually pleasing as provided by lamps of the harp and finial-type and, therefore, the present invention seeks to overcome that disadvantage by providing an inexpensive mechanism for supporting a finial on spring clip-supported lampshades (the term used for the lampshade which grips the light bulb) so that even these less expensive lamps and lampshades are provided with a finial and a more finished, elegant looking appearance.

SUMMARY OF THE INVENTION

The present invention has, as its principle object, the providing of a simple and inexpensive mechanism for supporting a decorative finial above the spring clips of an inexpensive type lampshade. This shade is suspended by the spring clips gripping around a lightbulb.

It is an object of the present invention to selectively provide a finial to a less expensive table lamp in a relatively inexpensive manner and, yet, to do so without providing the harp, flat or disk surface, center ring of the lampshades, of more expensive table lamps and shades.

It is a further object of the present invention to provide a mechanism, for selectively securing a finial to a table lamp in an inexpensive manner, which is also selectively removable from the lampshade so that, if desired, a finial need not be presented.

It is a further object of the present invention to provide a means for securing a finial to a less expensive table lamp in a minimum of time. Thus, the device can be retrofitted to existing hoop-style lampshades which are secured to table lamps not by means of a harp but, rather, by the downwardly extending spring clips which surround and grip onto the curved portion of the lightbulb.

These and other objects, as will be more fully explained herein, are sought to be accomplished by the present invention.

BRIEF DESCRIPTION OF THE DRAWINGS

FIG. 1 is a top plan view of a lampshade supported by a lightbulb by spring clips and the inventive mechanism removably yet secured to the parallel, diameter wires of the lampshade, with a finial secured thereto;

FIG. 2 is a partial, cross-sectional view taken along lines 2—2 of FIG. 1;

FIG. 3 is an enlarged, partial, cross-sectional view taken along line 3—3 of FIG. 2 and showing the center plate portion of one embodiment of the inventive mechanism, with a finial secured thereon, all shown attached to the metal wires of the lampshade and supported by a lightbulb;

FIG. 4 is a side cross sectional view taken along lines 4—4 of FIG. 2 and showing one embodiment of the inventive mechanism, without the finial attached, yet supported by the pair of parallel wires of the lampshade;

FIG. 5 is a perspective view of the inventive mechanism, with finial attached, shown supported by the parallel wires of the lampshade;

FIG. 6 is an exploded, bottom perspective view of a second and preferred embodiment of the inventive mechanism and showing the finial;

FIG. 7 is an enlarged partial view, similar to FIG. 2, yet showing the now preferred embodiment of the present invention;

FIG. 8 is a view similar to FIG. 3, yet taken along line 8—8 of FIG. 7; and FIG. 9 is a cross sectional view taken along lines 9—9 of FIG. 7.

DETAILED DESCRIPTION OF THE DRAWINGS AND THE PREFERRED EMBODIMENT OF THE PRESENT INVENTION

As best understood by those of ordinary skill in the art, an ordinary yet relatively expensive table lamp is provided with a socket for providing electric power to a lightbulb. The lamp is, of course, electrically connected to household current in a well-known and conventional manner. More expensive table lamps are provided with lampshades which are secured about the lightbulb by use of an upside down U-shaped harp. The harp has two downwardly extending legs which are forced into holders and secured to the table lamp with the legs of the harp extending above and around the lightbulb. At the base or top of the harp, a circular and flat small disk is provided and, located within its center is an upwardly extending screw threaded portion. A lampshade is capable of being selectively secured and suspended on the disk of the harp since the lampshade is provided with a plurality of spokes which extend between the upper metal hoop portion of the lampshade and a centrally located flat ring. The flat ring fits over the upwardly extending threaded portion of the harp and sits on the small disk-like area. With the central ring of the lampshade placed over the disk-like area of the harp, a finial of a visually attractive appearance is screwed over the upwardly extending screw threads to "finish off" the overall visual effect and, in addition, to provide a means for securing, in place, the lampshade over the harp and the table lamp.

The present invention, however, departs from the prior art in that it seeks to provide a decorative finial to a less expensive table lamp. These lamps are not provided with a harp for supporting the lampshade about the bulb, but rather, the present invention relates to those lampshades which are suspended by a pair of spring clips secured to the bulb itself. These lampshades are provided with downwardly extending generally round spring clips which together snap over the curvature of the electric bulb and, in this manner, serve to support and suspend the lampshade. These, too, are well known to those of ordinary skill in the art.

As best seen in the drawings, these lampshades 18 are provided with an upper circular hoop 20 which supports the fabric 21 for the lampshade. A lower hoop 31 serves to keep the fabric taut yet away from the lamp and together with the upper hoop 20 and fabric 21 form a frusto-conical shade 18. The upper hoop 20 is generally made of thin metal, yet rigid, parallel wires. Likewise, thin metal, yet rigid, wire, serving as spokes, 23 and 25 serve to connect one part of the upper circular hoop 20 to the downwardly extending, generally circular spring clips 22 and 24 which, as mentioned, secure and snap between them the lightbulb 19 in order to support the lampshade 18 about the table lamp. The lightbulb 19, itself, is thus the mechanism for supporting the lampshade 18.

The present inventive mechanism 30 (best seen in FIG 5) is intended to be selectively secured to and removable from the thin metal wires of the spokes 23 and 25 which extend substantially across the center of the lampshade 18.

The mechanism 30 comprises a relatively flat metal plate portion 32 which has a pair of ears or tabs 33 and 34 which extend first downwardly and then fold back under plate 32. The length of the first downward extension of the ears 33 and 34 is sufficient so that the folded back or underneath located portions extend below the bottom of the spokes 23 and 25 and, yet, the ears or tabs frictionally engage the underside surface of the metal wires so that the device is generally secured, as desired, on the metal wires. In the present preferred embodiment of the present invention, the entire mechanism 30 and certainly the tabs or ears 33 and 34 are resiliently flexible so that the device can be twisted on and off the spokes, selectively grip around them and, yet, be removable therefrom. Thus, the folded back portions 27 and 29 extend below the metal plate 32 by the length of the section 31 which is about equal to yet slightly greater than the diameter of the wires comprising the spokes 23 and 25.

Centrally located on the metal plate 32 is an aperture 36 (See FIG. 3) which is, itself, provided with internal screw threads. These screw threads serve to support and secure a decorative finial 45. The finial can have exterior, downwardly directed screw threads either integral with the finial or provided by an insert member received by the finial. The screw threads of the finial are received within the aperture 36 of the metal plate. In this manner, the metal plate 32 serves to support a decorative finial 45 on a less expensive lamp and its lampshade 18 which is secured to the lamp not by a harp but, rather, by downwardly extending spring clips 22 and 24.

One end of metal plate 32 has ear 33 bent down on one side of one wire of spoke 25 while the other end of metal plate 32 has ear 34 bent down over one wire of spoke 23 in opposed relation to ear 33. This is best seen in FIG. 5.

To install the device, the factory worker or ultimate consumer merely takes one ear, 33 for example, and wraps it around one set of spoke wires 25 while twisting or turning the metal plate such that the other ear 34 wraps around the opposed spoke wires 23.

A clockwise turning (viewed from above) clips the device onto the spoke wires while a counterclockwise twisting disengages and allows removal of the device from the spoke wires of the lampshade. As thus assembled, the aperture 36 overlies the center of the bulb 19. Then the screw threads of the decorative finial 45 are screwed into the interior screw threads of the aperture of the metal plate or, alternatively, secured over the upwardly extending screw threads of the plate (depending on embodiment). In this manner, a spring clip-type lampshade is provided with a decorative finial.

A different and now preferred embodiment of the present invention is shown in FIGS. 6–9. In this embodiment, the device 132 is molded from a resilient, flexible and plastic material. This allows the device to be inexpensively yet accurately made, in large quantities. Here, again, the ears or tabs 161 and 163 extend down and then fold back beneath the plate portion of the device. The resiliency of the ears 161–163 of the device allow the device to be snapped on and off over the wires of the spokes 23 and 25. In this embodiment, the finial 145 has the downward protruding screw threads 147 which are secured to the device by a nut 151 (See FIGS. 7 and 9). In this embodiment of the invention, each of the ears 161 and 163 have an upwardly projecting lip or ridge 170. The lip or ridge 170 serves to snap behind and secure the device to the spokes 23 and 25. This prevents accidental or unintentional removal. The lip or ridge 170 allows selective removal by flexing or moving the lip or ridge 170 away from the underside of the plate portion, which is facilitated by the resiliency and flexibility of the device.

While the present invention has been illustrated and described herein it is to be appreciated that the scope of the invention is defined by the appended claims and the illustrated and described embodiment is merely representational, only.

I claim:

1. A device for providing a finial on a table lamp having a metal hoop-type lampshade which is releasably secured to said lamp by a pair of opposed spring clips which grip a lightbulb held in said lamp, said spring clips being connected to said hoop of said lampshade by spokes, comprising:

(a) a plate member;

(b) wire securing means extending from said plate member for releasably securing said plate member to said spokes said wire securing means comprising a pair of opposed tabs which selectively grip and release said spoke wires; and (c) said plate member having finial holding means for a finial.

2. A device as claimed in claim 1 wherein said pair of opposed tabs extend downwardly a distance of about the diameter of said spokes.

3. A device as claimed in claim 1 wherein said finial holding means is an aperture provided with internal screw threads.

4. A device as claimed in claim 1 wherein said wire securing means is formed from a flexible and resilient material.

5. A device as claimed in claim 1, wherein each of said tabs have spoke locking means to releasably secure said tabs and said device to said spokes.

6. A device as claimed in claim 5, wherein said spoke locking means is an upwardly protruding ridge.

* * * * *